US011351687B2

(12) United States Patent
Bunnell

(10) Patent No.: US 11,351,687 B2
(45) Date of Patent: Jun. 7, 2022

(54) RAZOR HANDLE

(71) Applicant: Edgewell Personal Care Brands, LLC, Chesterfield, MO (US)

(72) Inventor: Jay Bunnell, Orange, CT (US)

(73) Assignee: EDGEWELL PERSONAL CARE BRANDS, LLC, Chesterfield, MO (US)

( * ) Notice: Subject to any disclaimer, the term of this patent is extended or adjusted under 35 U.S.C. 154(b) by 0 days.

(21) Appl. No.: 16/761,275

(22) PCT Filed: Nov. 14, 2018

(86) PCT No.: PCT/US2018/061001

§ 371 (c)(1),
(2) Date: May 4, 2020

(87) PCT Pub. No.: WO2019/108392

PCT Pub. Date: Jun. 6, 2019

(65) Prior Publication Data

US 2020/0282581 A1 Sep. 10, 2020

Related U.S. Application Data

(60) Provisional application No. 62/591,513, filed on Nov. 28, 2017.

(51) Int. Cl.
*B26B 21/52* (2006.01)

(52) U.S. Cl.
CPC ..... *B26B 21/521* (2013.01); *B26B 21/522* (2013.01)

(58) Field of Classification Search
CPC ..... B26B 21/00; B26B 21/02; B26B 21/14; B26B 21/16; B26B 21/22; B26B 21/225; B26B 21/52; B26B 21/521
(Continued)

(56) References Cited

U.S. PATENT DOCUMENTS 4,428,116 A * 1/1984 Chen ..... B26B 21/521 30/47
4,446,619 A 5/1984 Jacobson
(Continued)

FOREIGN PATENT DOCUMENTS

EP 1488894 A1 12/2004

OTHER PUBLICATIONS

International Search Report and Written Opinion issued in connection with PCT Application No. PCT/US2018/061001 dated Feb. 28, 2019.

*Primary Examiner* — Jason Daniel Prone

(57) ABSTRACT

A safety razor has a handle and a razor cartridge having a handle and a connector. The connector includes a recess with an opening portion and a remote portion at an end of the recess opposed the opening portion. The handle includes a first ejector connected to a user-operable button and a distal end portion of the first ejector is adapted to contact an interior surface of the remote portion of the recess. The button also includes a second ejector structure adapted to contact the opening portion of the recess. When the button is operated, the combined function of the distal end portion of the first ejector contacting and pushing against a surface of the remote portion of the recess and the second ejector structure contacting and pushing against the opening portion of the recess act to disconnect the razor cartridge from the handle.

8 Claims, 6 Drawing Sheets

(58) Field of Classification Search
USPC ..... 30/34.1, 47–51, 526–535; D28/48
See application file for complete search history.

(56) References Cited

U.S. PATENT DOCUMENTS 5,016,352 A * 5/1991 Metcalf ..... B26B 21/225 30/47
5,669,139 A * 9/1997 Oldroyd ..... B26B 21/222 30/47
5,787,586 A 8/1998 Apprille, Jr. et al.
6,026,577 A 2/2000 Ferraro
6,085,426 A * 7/2000 Metcalf ..... B26B 21/521 30/47
6,381,857 B1 * 5/2002 Oldroyd ..... B26B 21/225 30/526
6,425,184 B1 * 7/2002 Min ..... B26B 21/225 30/51
6,434,839 B1 * 8/2002 Lee ..... B26B 21/225 30/532
6,493,950 B1 * 12/2002 Kludjian ..... B26B 21/22 30/526
6,557,265 B2 * 5/2003 Coffin ..... B26B 21/225 30/50
6,560,881 B2 * 5/2003 Coffin ..... B26B 21/222 30/50
7,168,173 B2 * 1/2007 Worrick, III ..... B26B 21/222 30/527
7,219,430 B2 * 5/2007 Fandrey ..... B26B 21/38 30/527
7,574,809 B2 * 8/2009 Folio ..... B26B 21/225 30/527
7,685,720 B2 * 3/2010 Efthimiadis ..... B26B 21/521 30/527
7,770,294 B2 * 8/2010 Bruno ..... B26B 21/225 30/50
8,230,600 B2 * 7/2012 Hart ..... B26B 21/222 30/526
8,474,144 B2 * 7/2013 Royle ..... B26B 21/522 30/532
8,590,162 B2 * 11/2013 Park ..... B26B 21/225 30/50
8,732,955 B2 * 5/2014 Howell ..... B26B 21/225 30/50
8,793,880 B2 * 8/2014 Taub ..... B26B 21/521 30/50
8,844,145 B2 * 9/2014 Psimadas ..... B26B 21/521 30/526
8,991,058 B2 * 3/2015 Dimitris ..... B26B 21/225 30/34.1
9,999,981 B2 * 6/2018 Bunnell ..... B26B 21/521
10,807,259 B2 * 10/2020 Bunnell ..... B26B 21/521
10,807,260 B2 * 10/2020 Hitchcock ..... B26B 21/521
11,034,038 B2 * 6/2021 Chang ..... B26B 21/521
11,052,558 B2 * 7/2021 Lee ..... B26B 21/521
2003/0213130 A1 * 11/2003 Motta ..... B26B 21/225 30/50
2004/0181953 A1 * 9/2004 Follo ..... B26B 21/225 30/527
2004/0226178 A1 * 11/2004 Lukan ..... B26B 21/522 30/526
2006/0218804 A1 * 10/2006 Noble ..... B26B 21/526 30/526
2008/0034589 A1 * 2/2008 Nearing ..... B26B 21/521 30/32
2009/0119924 A1 * 5/2009 Bozikis ..... B26B 21/38 30/50
2009/0293292 A1 * 12/2009 Ramm ..... B26B 21/528 30/526
2014/0230255 A1 * 8/2014 Stevens ..... B26B 21/521 30/526
2014/0230258 A1 * 8/2014 Eagleton ..... B26B 21/521 30/527
2015/0174776 A1 * 6/2015 Hawes ..... B26B 21/521 30/526
2015/0290819 A1 * 10/2015 Giannopoulos ..... B26B 21/225 30/532
2015/0328788 A1 * 11/2015 Ren ..... B26B 21/521 30/526
2016/0001455 A1 * 1/2016 Swenson ..... B26B 21/521 30/57
2016/0101531 A1 4/2016 Bunnell
2017/0036363 A1 * 2/2017 Efthimiadis ..... B26B 21/52
2017/0326744 A1 11/2017 Liberatore
2020/0023532 A1 * 1/2020 Gratsias ..... B26B 21/522
2020/0039098 A1 * 2/2020 Kopelas ..... B26B 21/225
2020/0055207 A1 * 2/2020 Zucker ..... B26B 21/521
2020/0070376 A1 * 3/2020 Petratou ..... B26B 21/521
2020/0180177 A1 * 6/2020 Bunnell ..... B26B 21/521
2021/0008745 A1 * 1/2021 Kruemke ..... B26B 21/521
2021/0031391 A1 * 2/2021 Gratsias ..... B26B 21/225
2021/0122072 A1 * 4/2021 Ntavos ..... B26B 21/225
2021/0187769 A1 * 6/2021 Kopelas ..... B26B 21/521
2021/0268676 A1 * 9/2021 Liberatore ..... B26B 21/521
2021/0283792 A1 * 9/2021 Lee ..... B26B 21/521

* cited by examiner

RAZOR HANDLE

TECHNICAL FIELD

The present disclosure relates to safety razors and safety razor handles, and more specifically to razor handles that include structures to eject a razor cartridge mounted to the handle.

BACKGROUND

Many modern wet shaving razors, also known as safety razors, comprise a handle and a razor cartridge mounted to the handle. Some razors are so-called disposable razors wherein the handle and razor cartridge together are disposed of after use. Other razors may be in the form of a so-called system that comprises a handle that can be reused and a removable razor cartridge that is disposed of after use and can be replaced with a new cartridge.

U.S. Pat. No. 5,787,586 discloses a shaving system having a razor cartridge including a housing carrying razor blades, and a connector, also known as an interconnect member that pivotally supports the housing. A razor handle has a generally broad, flat extension providing cartridge support structure that engages a recess of the connector. The connector snap fits to the extension by engageable detents and depressions that are located closer to a remote end of the recess than to an entrance of the recess. The handle has a U-shaped ejector actuated by a user-operable button. When actuated, distal ends of legs of the ejector act upon a wall at the remote end of the recess to push the connector, with its housing, from the extension, disengaging the snap fit, and permitting the user to remove (and replace) the razor cartridge.

U.S. Pat. No. 4,446,619 discloses another shaving system having a razor cartridge including a housing carrying razor blades, and a connector structure integrally and rigidly formed with the housing. A razor handle has a generally broad, flat extension providing cartridge support structure that engages a recess of the connector. The connector snap-fittingly fits to the extension by engageable detents and depressions that are located closer to the entrance of the recess than to a remote end. The handle has a user-operable pusher, a free end of which acts on one side of the rim of the entrance. When actuated, the free end of the pusher acts upon the rim to push the connector, with its housing, from the extension, disengaging the snap fit, and permitting the user to remove (and replace) the razor cartridge.

U.S.-A1-2016/0101531 (now U.S. Pat. No. 9,999,981B2) discloses a further shaving system having a universal razor handle that can accept different razor cartridges, each including a housing carrying razor blades, on respective different connectors. The razor handle has an extension providing a first cartridge support structure that engages a recess of the first cartridge connector in a manner that can be similar to that of the previously mentioned '586 patent. The razor handle also has spaced panels providing a second cartridge support structure that engage a recess of the second cartridge connector. In some embodiments, each panel has detents that respectively engage depressions of the second cartridge connector. The handle has a U-shaped ejector actuated by a user-operable button. When actuated, distal ends of legs of the ejector act upon a wall at the remote end of the recess of either cartridge connector type as mounted to the handle, to push the connector, with its housing, from the extension, separating the respective engagements, permitting the user to remove (and replace) the razor cartridge.

In some embodiments of the '531 application/'981 patent, the depressions of the second cartridge connector can be located closer to the entrance of this connector than to the remote end of the recess. When the ejector is actuated, the distal ends of the ejector legs act to push on the wall at the remote end of the recess. This pressure can produce stresses in the connector that in turn cause a connector entrance width (defined between opposed depressions) to decrease. This in further turn increases the frictional engagement of the connector recess (and its depressions) to the spaced panels (and their detents), undesirably increasing the user-applied button force necessary to successfully remove the razor cartridge from the handle.

SUMMARY

The present disclosure has for its objective to eliminate, or at least substantially alleviate the limitations of the prior art by providing a safety razor comprising a handle and a razor cartridge. According to an aspect of the present disclosure, the handle has hand gripping structure and a first ejector slidable along the hand gripping structure and actuable by a user-operated button connected to the first ejector. The razor cartridge is connected to the handle, and comprises a housing carrying a razor blade, and a connector. The connector includes a recess having an opening portion with a rim, and a remote portion at an end of the recess opposed the opening portion. When the button is operated, a distal end portion of the first ejector contacts and pushes against an interior surface of the remote portion of the recess. The button further comprises a second ejector structure and when the button is operated, the second ejector structure contacts and pushes against the opening portion of the recess. In combination, the distal end portion of the first ejector contacting and pushing against a surface of the remote portion of the recess and the second ejector structure contacting and pushing against the opening portion of the recess act to disconnect the razor cartridge from the handle.

According to another aspect of the present disclosure, the first ejector comprises a pair of legs arranged in a U-shape with the legs disposed on opposed sides of a central plane of the safety razor, and a distal end portion of each leg is adapted to contact the interior surface of the remote portion of the recess.

According to either aspect above, the second ejector structure is one of integrally formed with, and connected to the button.

According to any of the aspects and embodiments described herein, when the button is operated, the distal end portion of the first ejector contacts the interior surface of the remote portion of the recess simultaneously with the second ejector structure contacting the opening portion of the recess.

According to any of the aspects and embodiments described herein, a path of movement of the razor cartridge away from the handle during ejection is non-linear.

According to any of the aspects and embodiments described herein, the second ejector structure contacts the opening portion of the recess at a plurality of locations.

According to any of the aspects and embodiments described herein, the second ejector structure contacts the opening portion of the recess at the rim.

In operation, combined actions of the first ejector and second ejector structure can overcome any increased engagement forces and permit a user to remove the razor cartridge from the handle with an acceptable user-provided force. These and other advantages of the present disclosure will be apparent to one of ordinary skill in the art in light of the following Detailed Description and Drawings.

BRIEF DESCRIPTION OF THE DRAWINGS

Reference is made to the attached drawings, wherein elements having the same reference numeral designations represent like elements throughout, and wherein.

DETAILED DESCRIPTION

Figure 1:
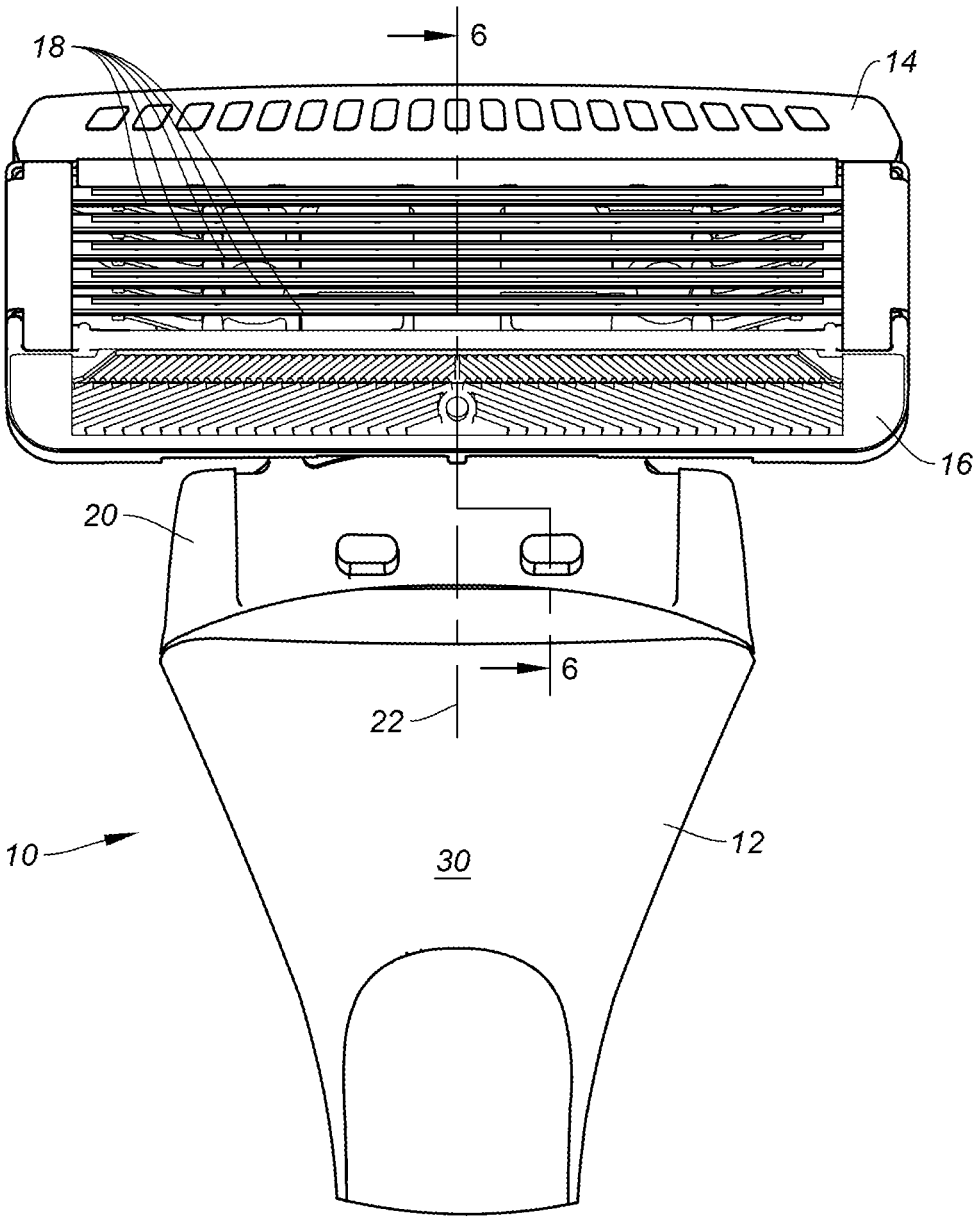
FIG. 1 is a front view of a safety razor.
Figure 2:
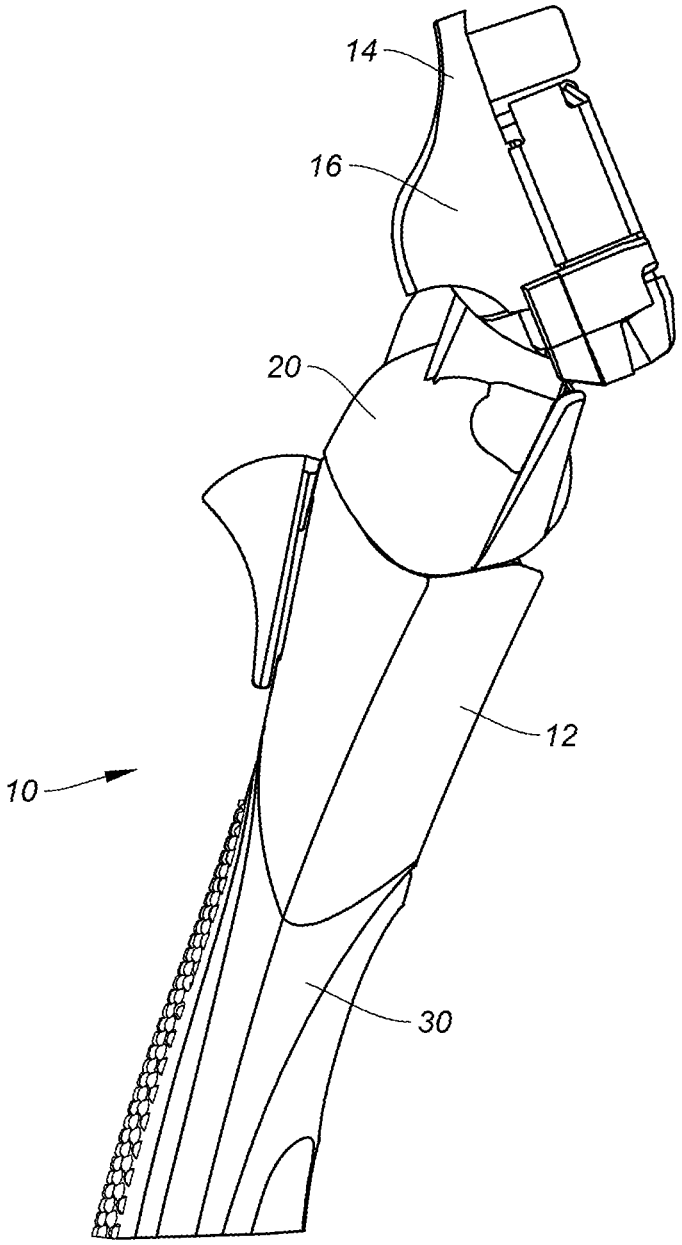
FIG. 2 is a side view of the safety razor of FIG. 1.

Referring now to the drawings and in particular FIGS. 1-2, a safety razor 10 is depicted. The safety razor 10 comprises a handle 12 having connected thereto a razor cartridge (cartridge) 14. In these figures, and also FIGS. 4-7, the handle 12 is shown truncated purely for the convenience of representing these figures at a suitable scale and the present invention is not limited in regard to the length or shape of the handle 12. The razor cartridge 14 comprises a housing 16 carrying one or more razor blades 18 mounted within the housing 16. The housing 16 is supported by a connector 20. In the depicted embodiment the housing 16 can be pivotally supported by the connector 20 such that the housing 16 can pivot relative to the connector 20 about a pivot axis. In the depicted embodiment the housing 16 has pivotal support structure comprising shell bearings as known in the art, although the present disclosure should not be limited in this regard and other support methods such as pins in holes and so-called living hinges are within the scope of the present disclosure. The housing 16 can also be rigidly supported, e.g. non-pivotally supported by the connector 20 or integrally formed with the connector 20, for example as described in U.S. Pat. No. 6,026,577, the content of which relating to an integral housing (described as head 11 therein) and connector (described as chamber 15 therein) is incorporated herein for reference. The safety razor 10 can define a center plane 22.

Figure 3:
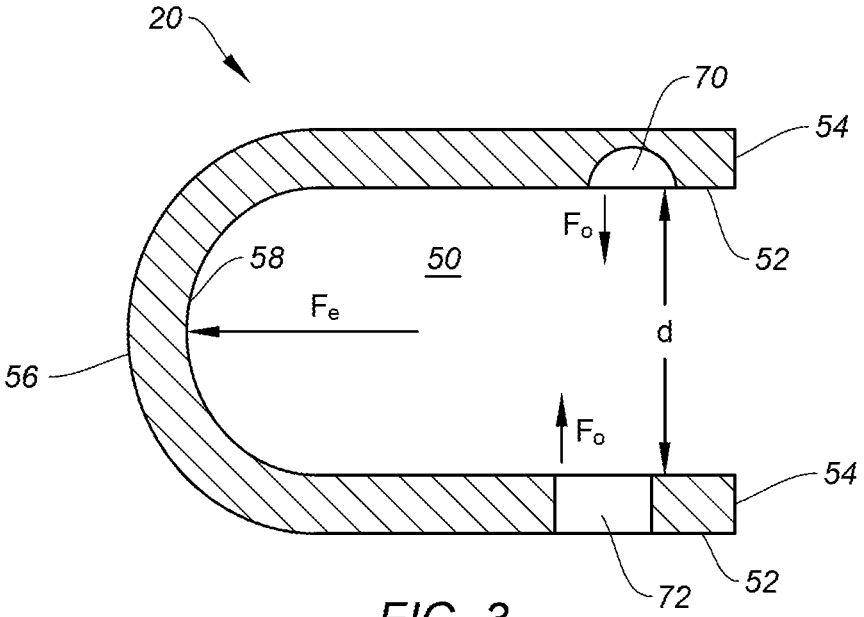
FIG. 3 is a schematic sectional view of a connector.

Referring additionally to FIG. 3, connector 20 includes a recess 50 having an opening portion 52 with a rim 54, and a remote portion 56 opposed the opening portion 52. The remote portion 56 has an interior surface 58 against which, distal ends 46 of legs 44 of a first ejector 40 (described as follows) push when a user actuates the button 42 (connected to the ejector 40) to remove the cartridge 14 from the handle 12. The connector 20 has opposed depression 70, 72 that are engaged by detents 62, 66 of spaced panels 60; 64 respectively of the razor handle 12 (described as follows) to secure the cartridge 14 to the handle 12 for normal use of the safety razor 10. Without being bound by theory, the applicant has discovered in a device similar to that of the '531 application, when the first ejector 40 is actuated, the ejector force (Fe in FIG. 3) of the distal ends 46 acting against interior surface 58 can induce stresses in the connector that in turn cause a connector entrance width "d" defined between opposed depressions 70, 72 to decrease. This in turn creates inwardly directed forces Fo at the opening portion that increase the frictional engagement of the connector recess 50 (and its depressions 70, 72) to the spaced panels 60, 64 (and their detents 62, 66), increasing engagement forces and undesirably increasing the user-applied button force necessary to successfully remove the razor cartridge 14 from the handle 12.

Figure 4:
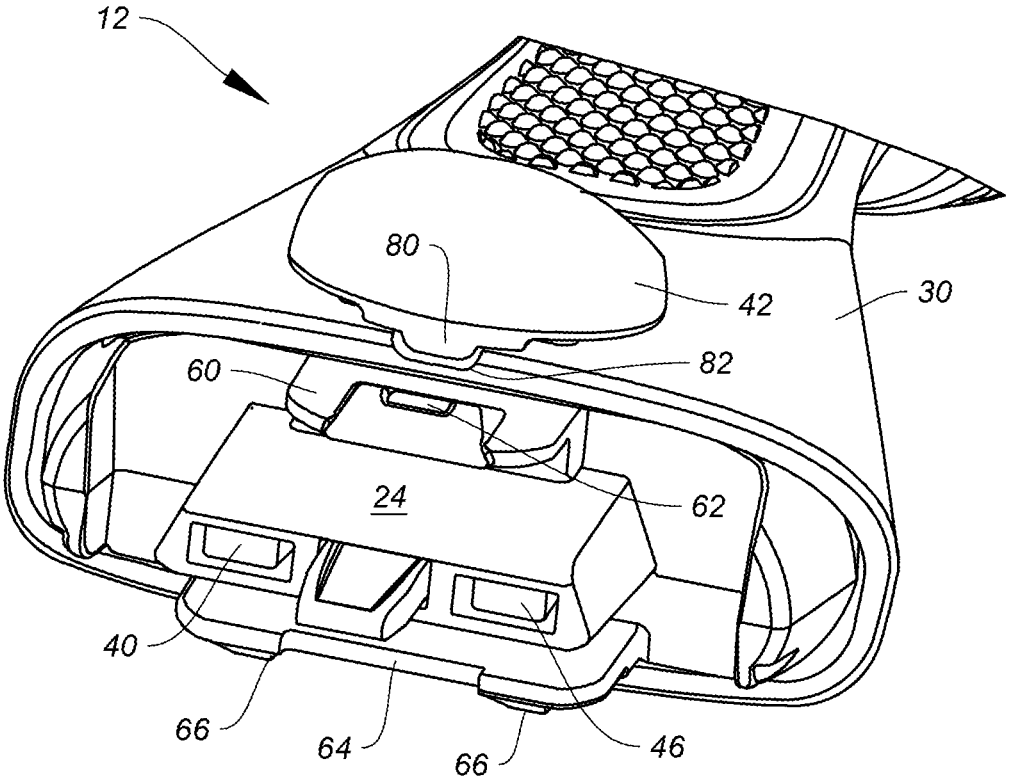
FIG. 4 is a perspective view of the razor handle alone of FIG. 1.
Figure 5:
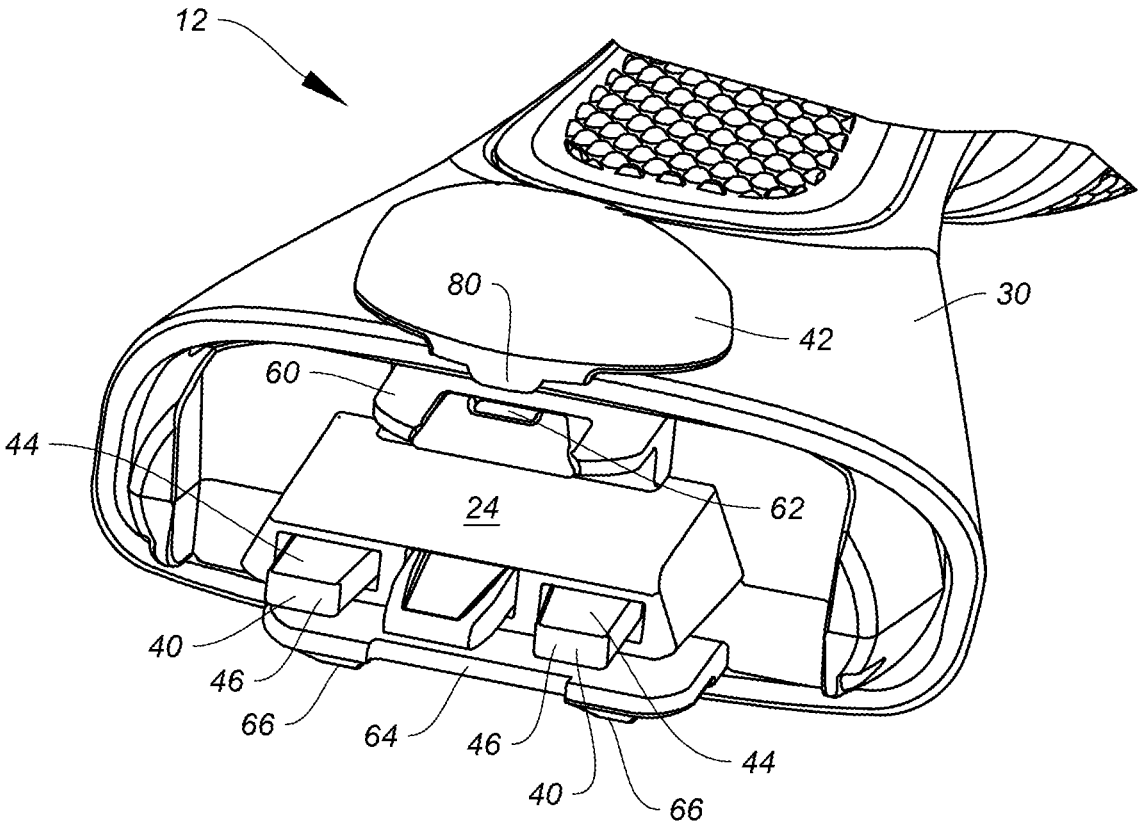
FIG. 5 is a perspective view of the razor handle alone of FIG. 1, with the button in an 'eject' position.

Referring to FIGS. 4 and 5, these depict perspective views of the handle 12 alone of the safety razor 10 of FIG. 1 respectively with the button 42 and its connected first ejector 40 in an at-rest position and a user actuated position to eject a razor cartridge 12. The handle includes hand gripping structure 30 and a first ejector 40 that is slidable along the hand gipping structure 30 and actuated by a user operating a button 42 connected to the ejector 40. First ejector 40 can be U-shaped, having legs 44 disposed on opposed sides of the center plane 22 and having distal ends 46. The distal ends 46 of each leg 44 are adapted to contact and push against an interior surface (58, see FIGS. 3, 6 and 7) of the connector 20 of the razor cartridge 14 when a user operates the button 42 to disconnect or otherwise eject the razor cartridge 14 from the handle 12.

The handle 12 includes opposed panels 60, 64 each bearing detents 62, 66 adapted to engage depressions 70, 72 of the connector 20 to connect the cartridge 14 to the handle 12.

The handle 12 can also include extension 24 adapted to engage another type of razor cartridge and its connector. This is described in U.S.-A1-2016/0101531, the subject matter of which is incorporated herein in its entirety as this pertains to connection between a razor cartridge and a handle. In the context of the present disclosure, the interconnective features, e.g. decent and respective depression, can be provided between the extension 24 and the connector 20 and/or the panels 60, 64 and connector. As depicted herein, the connector 20 bears the depressions 70, 72 but this interconnective arrangement can be fully or partially reversed such that the connector bears some or all of the detents 62, 66.

Figure 8:
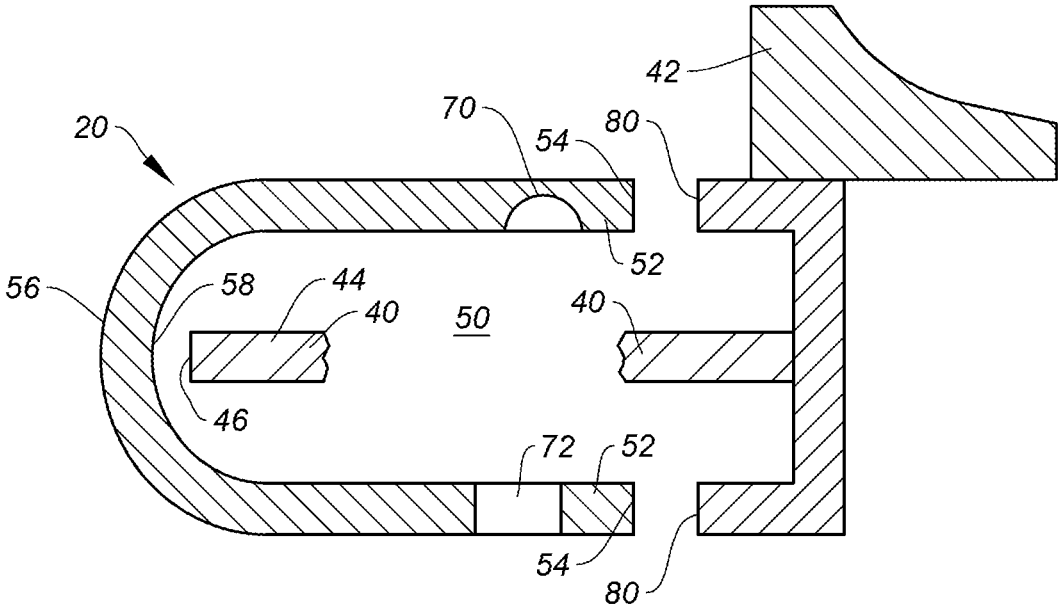
FIG. 8 is a schematic sectional view of another connector and ejector.

The button 42 also includes a second ejector structure 80 adapted to contact and push against the opening portion 52 of the connector of the razor cartridge 14 when a user operates the button 42 to disconnect or other se eject the razor cartridge 14 from the handle 12. Preferably, the second ejector structure 80 contacts and pushes against the rim 54 of the opening portion 52. Preferably (as shown in FIGS. 4 and 5), the second ejector structure 80 is integrally formed with the button 42. The second ejector structure 80 can also be a separate component part that is connected to the button 42 (as shown in FIG. 8). The second ejector structure 80 can be received in, and slide along a groove 82 of the handle 12.

Figure 6:
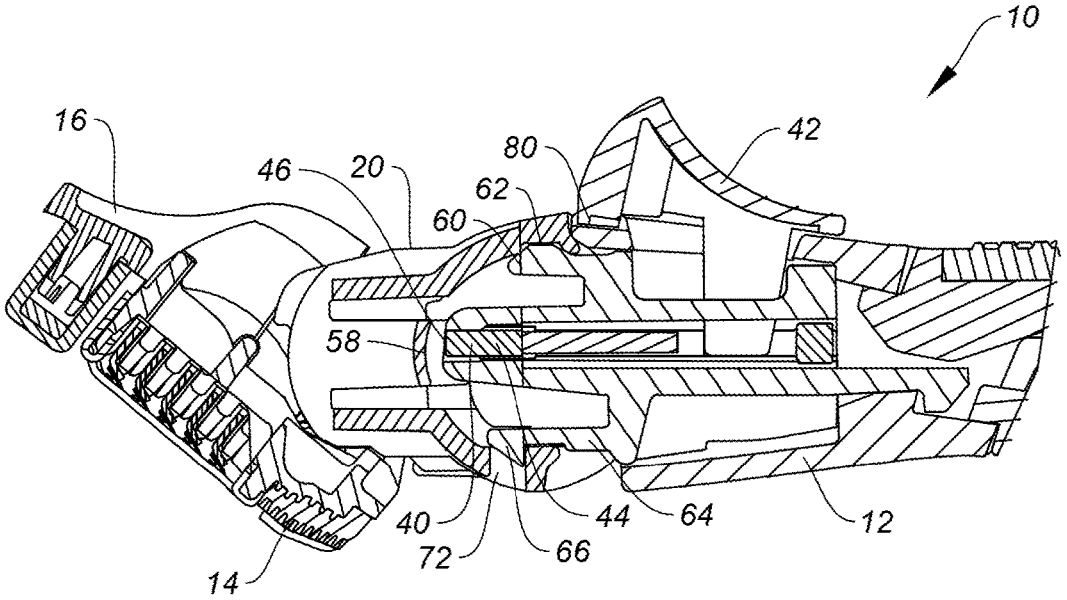
FIG. 6 is a sectional view of FIG. 1 taken along lines 6-6 shown in FIG. 1.
Figure 7:
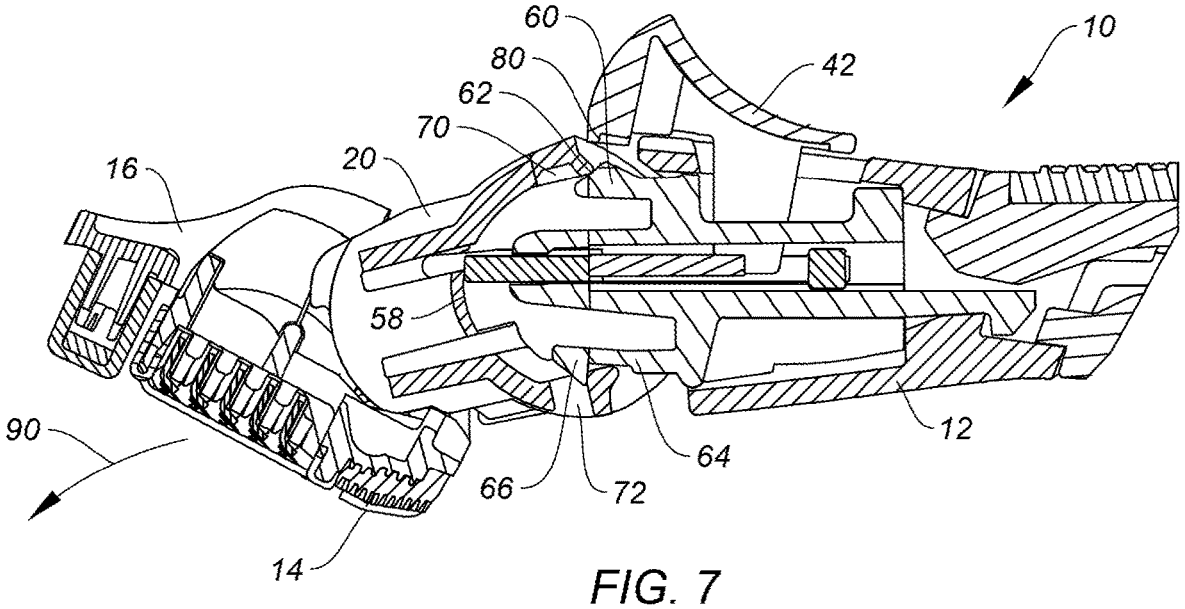
FIG. 7 is a sectional view of the safety razor shown in FIG. 1, taken along lines 6-6 of FIG. 1, with the button in the position of FIG. 5.

Referring additionally to FIGS. 6 and 7, these depict sectional views of the safety razor 10 of FIG. 1. Respectively these depict the cartridge 14 connected to the handle 12 and the button 42 in its at-rest position and the cartridge 14 being ejected from the handle 12 after a user has actuated the button 42. As can be seen in FIG. 7 with reference to FIG. 6, a path 90 of movement of the cartridge 14 away from the handle 12 during ejection is non-lifter when the second ejector structure 80 acts against the opening portion 52 on a single side of the connector 20.

Referring additionally to FIG. 8, this depicts a schematic sectional view of the connector 20 and button 42 with thereto connected first ejector 40 spaced from but adapted to push against the interior surface 58 and the second ejector structure 80 spaced from but adapted to push against (the rim 54) of the opening portion 52. Respective pushing actions can be synchronized to occur simultaneously or sequentially. For example, the second ejector structure 80 can contact the opening portion 52 slightly before the first ejector 40 contacts the interior surface 58.

Combined actions of the first ejector 40 and second ejector structure 80 can overcome any increased engagement forces and permit a user to remove the cartridge 14 from the handle 12 with an acceptable user-provided force.

Those skilled in the art will recognize that variations and modifications can be made without departing from the true scope of the disclosure as defined by the claims that follow. Features disclosed in connection with any one embodiment can be used alone or in combination with, each feature of the respective other embodiments.

The invention claimed is:

1. A safety razor (10), comprising:

a handle (12) having hand gripping structure (30) and a first ejector (40), slidable along the hand gripping structure (30) and actuable by a user-operated button (42) connected to the first ejector (40);

a razor cartridge (14) connected to the handle (12), comprising a housing (16) carrying a razor blade (18), and a connector (20); the connector (20) including a recess (50), the connector (20) having an opening portion (52) having a rim (54), and a remote portion (56) opposed the opening portion (52);

wherein the handle (12) includes opposed panels (60, 64) each bearing at least one detent (62, 66) adapted to be received in the recess and engage depressions (70, 72) of the connector (20) to connect the cartridge (14) to the handle (12);

wherein, when the button (42) is operated, a distal end portion (46) of the first ejector (40) contacts and pushes against an interior surface (58) of the remote portion (56);

wherein the button (42) further comprises a second ejector structure (80) and when the button (42) is operated, the second ejector structure (80) contacts and pushes against the rim of the opening portion (52); and wherein, in combination, the distal end portion (46) of the first ejector (40) contacting and pushing against the interior surface (58) of the remote portion (56) and the second ejector structure (80) contacting and pushing against the rim of the opening portion (52) act to disconnect the razor cartridge (14) from the handle (12).

2. The safety razor (10) of claim 1, wherein the first ejector (40) comprises a pair of legs (44) arranged in a U-shape with the legs (44) defining the distal end portion (46) disposed on opposed sides of a central plane (22) of the safety razor (10) and the distal end portion (46) defined by the legs (44) is adapted to contact the interior surface (58) of the remote portion (56).

3. The safety razor (10) of claim 1, wherein the second ejector structure (80) is integrally formed with the button (42).

4. The safety razor (10) of claim 1, wherein the second ejector structure (80) is connected to the button (42).

5. The safety razor (10) of claim 1, wherein the second ejector structure (80) is received in a groove (82) of the handle (12).

6. The safety razor (10) of claim 1, wherein, when the button (42) is operated, the distal end portion (46) of the first ejector (40) contacts the interior surface (58) of the remote portion (56) simultaneously with the second ejector structure (80) contacting the opening portion (52).

7. The safety razor (10) of claim 1, wherein the second ejector structure (80) contacts the rim of the opening portion (52) at a plurality of locations.

8. The safety razor (10) of claim 1, wherein the second ejector structure (80) contacts the rim (54).

* * * * *